US009310036B1

(12) United States Patent
Kathawate et al.

(10) Patent No.: US 9,310,036 B1
(45) **Date of Patent: *Apr. 12, 2016**

(54) RETROFIT MOUNTING DEVICE FOR OPEN FRAME CEILING

(71) Applicant: Cooper Technologies Company, Houston, TX (US)

(72) Inventors: Jyoti Gururaj Kathawate, Smyrna, GA (US); Charles Richard Vasquez, Peachtree City, GA (US); Jared M. Davis, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/733,375

(22) Filed: Jun. 8, 2015

Related U.S. Application Data

(63) Continuation of application No. 14/014,203, filed on Aug. 29, 2013, now Pat. No. 9,052,101.

(51) Int. Cl.

| | |
|---|---|
| ***F21S 8/02*** | (2006.01) |
| ***F21K 99/00*** | (2010.01) |
| ***F21V 19/00*** | (2006.01) |
| ***F21V 21/04*** | (2006.01) |

(52) U.S. Cl.
CPC . *F21S 8/024* (2013.01); *F21K 9/10* (2013.01); *F21V 19/004* (2013.01); *F21V 21/047* (2013.01)

(58) Field of Classification Search
USPC ..... 362/404, 147, 148, 150, 396, 364, 365
See application file for complete search history.

(56) References Cited

U.S. PATENT DOCUMENTS

| | | | | |
|---|---|---|---|---|
| 4,188,656 | A * | 2/1980 | Howard | 362/365 |
| 5,031,084 | A * | 7/1991 | Russo et al. | 362/365 |
| 5,957,572 | A * | 9/1999 | Wedekind et al. | 362/365 |
| 6,082,878 | A * | 7/2000 | Doubek et al. | 362/365 |
| 7,364,323 | B2 * | 4/2008 | Francois | 362/267 |
| 8,403,541 | B1 * | 3/2013 | Rashidi | 362/373 |
| D685,118 | S * | 6/2013 | Rashidi | D26/74 |
| 9,052,101 | B1 * | 6/2015 | Kathawate et al. | |
| 2005/0207146 | A1 * | 9/2005 | Reggiani | 362/150 |
| 2009/0284958 | A1 * | 11/2009 | Pickard et al. | 362/147 |
| 2010/0265725 | A1 * | 10/2010 | Wilcox | 362/364 |
| 2011/0134650 | A1 * | 6/2011 | Verma et al. | 362/362 |
| 2014/0140075 | A1 * | 5/2014 | Schmitt et al. | 362/382 |

OTHER PUBLICATIONS

Juno Lighting Group, Juno indy LRT6, Product Brochure, Jul. 2013.
Lithonia Lighting, Lithonia RV8, Specification sheet, Jul. 31, 2013.
Capri Lighting, Capri CM6R, Specification sheet, Nov. 2007.
Philips Omega, RV-11-25, Specification sheet, Apr. 2012.

* cited by examiner

*Primary Examiner* — Laura Tso
(74) *Attorney, Agent, or Firm* — King & Spalding LLP

(57) ABSTRACT

The present disclosure provides a mounting device for mounting light fixtures into new or existing ceiling mounting openings. The mounting device allows new light fixtures to be retrofitted into existing ceiling openings by providing the appropriate interface between the light fixture and the ceiling opening. In certain example embodiments, the mounting device includes a ceiling coupling mechanism configured to secure the mounting device within an opening in a ceiling. The mounting device further includes a light fixture coupling element configured to couple to and retain a light fixture, thereby mounting the light fixture to the ceiling.

19 Claims, 4 Drawing Sheets

RETROFIT MOUNTING DEVICE FOR OPEN FRAME CEILING

PRIORITY CLAIM

The present application is a continuation of and claims priority under 35 U.S.C. §120 to U.S. patent application Ser. No. 14/014,203, filed Aug. 29, 2013, and titled "Retrofit Mounting Device For Open Frame Ceiling," the entire contents of which are incorporated herein by reference.

TECHNICAL FIELD

The present disclosure relates generally to a light fixture mounting device. Specifically, the present disclosure relates to a light fixture mounting device capable of mounting a variety of different light fixtures into a ceiling opening.

BACKGROUND

Light technology is constantly improving towards new products with improved efficiency, more advanced lighting and control effects, and overall technological advances. For example, light emitting diode (LED) based luminaires are quickly replacing many conventional lighting types due to their increased efficiency, lifespan, form factor, and various other advantages over the conventional lighting types. As another example, many newly developed luminaires are capable of producing various custom lighting effects and control options not available in conventional luminaires. As such, it is often desired to replace an existing light fixture with a newer, more technologically advanced light fixture. However, in some situations, the existing light fixtures were installed or embedded within a wall or ceiling, in which an opening was especially created at the time to accept such existing light fixture. This often poses a challenge when the existing luminaire is to be replaced with a new light fixture with which the existing opening is not exactly compatible. Additionally, in certain cases, the existing light fixture may have been removed to make way for the new light fixture, however the housing or mount of the existing light fixture may not be easily removed, such as if the housing was permanently installed into the wall or ceiling.

SUMMARY

In an example embodiment of the present disclosure, a mounting ring includes a cylindrical body ring comprising a top end, a bottom end, an outer side, and an inner side. The mounting ring further includes at least one spring receiver disposed on the body ring, at least one retention spring disposed on the body ring and comprising an outwardly extending arm, wherein the arm is horizontal in a neutral position and vertical in a flexed position. The mounting ring further includes a flange disposed on the bottom end and extending outwardly from the body ring, wherein the at least one retention spring and the flange grip a portion of a surface therebetween when the mounting ring is disposed within the surface.

In another example embodiment of the present disclosure, a mounting device, includes a body frame comprising a first open end, a second open end, an inside, and an outside. The mounting device further includes at least one coupling receiver disposed on the inside of the body frame, wherein the coupling receiver is engaged with and retains at least one coupling feature of a light fixture when the light fixture is inserted within the mounting device, and wherein the body ring is retainable within an existing opening in a ceiling.

In another example embodiment of the present disclosure, a mounting device includes an open frame comprising a top end, a bottom end, an outer side, and an inner side. The mounting device also includes at least one fixture receiver disposed on the frame configured to engage with at least one coupling element of a fixture, wherein the mounting device supports the fixture via the engagement of the at least one fixture receiver with the at least one coupling element of the fixture. The mounting device further includes at least one ceiling attachment feature coupled to the frame configured to secure the mounting device within an opening in a ceiling.

In another example embodiment of the present disclosure, a mounting nng includes a flexible body ring comprising a first end and a second end, wherein the body ring is flexible between the first and the second end, and wherein the diameter of the body ring decreases when the first and second end are flexed towards each other and increases when the body ring is released from being flexed. The mounting ring also includes at least one fixture receiver disposed on the body ring configured to engage with at least one coupling element of a fixture, wherein the mounting ring supports the fixture via the engagement of the at least one fixture receiver with the at least one coupling element of the fixture. The mounting ring further includes at least one ceiling attachment feature coupled to the frame configured to secure the mounting device within an opening in a ceiling.

BRIEF DESCRIPTION OF THE DRAWINGS

For a more complete understanding of the disclosure and the advantages thereof, reference is now made to the following description, in conjunction with the accompanying figures briefly described as follows.

Figure 1:
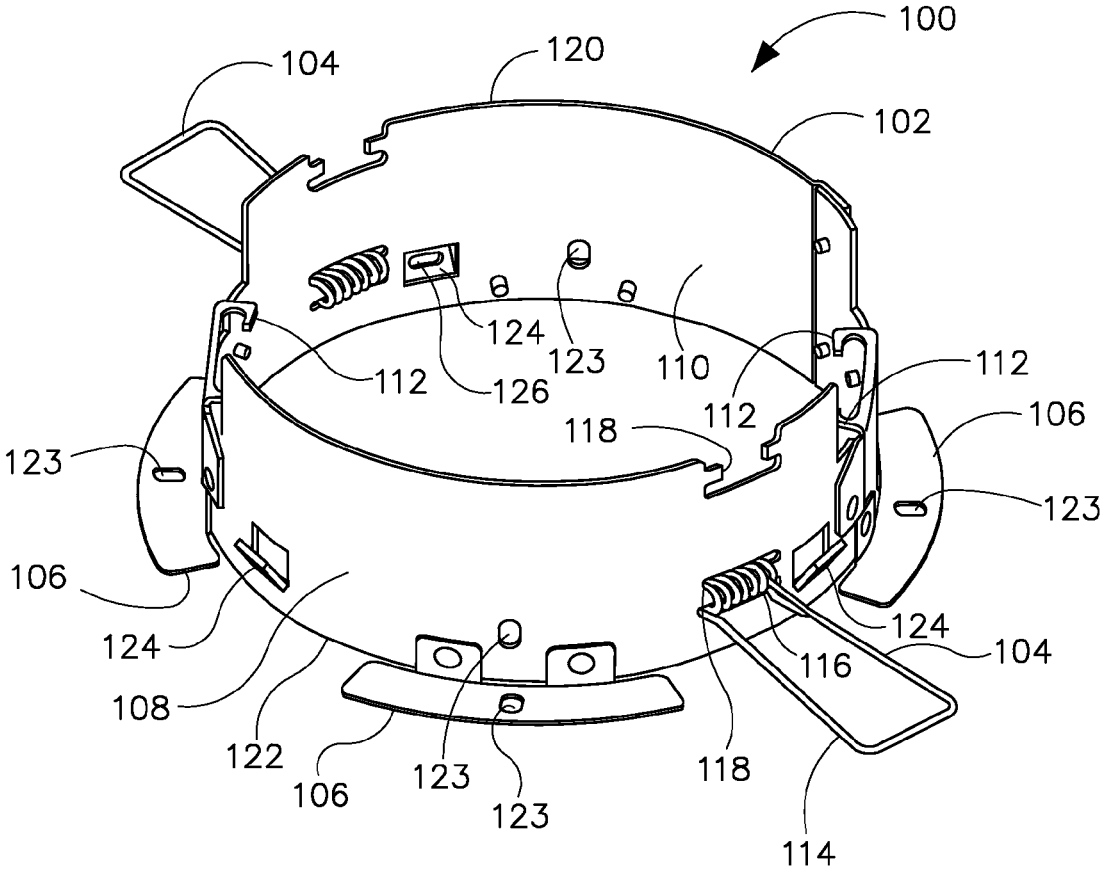
FIG. 1 illustrates a perspective view of a mounting ring for open frame ceilings, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of example with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s). The present disclosure makes reference to light fixtures as an example fixture mountable to a ceiling via the provided systems and techniques. However, the systems and techniques disclosed herein are applicable to other types of fixtures other than light fixtures. Additionally, the systems and techniques provided herein are applicable to mounting structures other than ceilings, such as walls, boards, and the like.

The present disclosure provides a mounting ring 100 for mounting light fixtures into new or existing ceiling mounting openings. The mounting ring allows new light fixtures to be retrofitted into existing ceiling openings by providing the appropriate interface between the light fixture and the ceiling opening. In certain example embodiments, the mounting ring 100 also allows for a new light fixture to be mounted into an existing ceiling opening in which a permanent housing is already installed. The mounting ring 100 is able to mount a variety of different types of styles of light fixtures.

FIG. 1 illustrates the mounting nng 100, in accordance with example embodiments of the present disclosure. Referring to FIG. 1, the mounting ring 100 includes a body ring 102, a plurality of retention springs 104, a plurality of flanges 106, and a pair of torsion spring receivers 112. The body ring 102 has a hollow cylindrically shaped wall with an open top end 120 and an open bottom end 122. As the body ring 102 has an open cylindrical shape, the body ring 102 further includes an outside 108 and an inside 110. The body ring 102 is fabricated from a sufficiently strong material, such as steel, aluminum, certain plastics, and the like. In an example embodiment, the body ring 102 is fabricated from two pieces of material which are riveted together. In another example embodiment, the body ring 102 is fabricated entirely from one piece of material. In different embodiments, the body ring 102 may have different heights, thicknesses, or diameters. During use, the body ring 102 is mounted within a ceiling opening and a light fixture is mounted onto and within the body ring 102.

Each of the retention springs 104 further include a spring arm 114 and a spring coil 116. The spring coil 116 is disposed within a portion of the wall of the body ring 102. Specifically, the wall of the body ring 102 includes a slot 118 in which the spring coil 116 is disposed. The slot 118 further includes one or two protrusions around which the spring coil 116 envelops. Thus, the spring coil 116 is retained by and is allowed to pivot about the protrusions and the slot 118. The retention spring 104 is substantially horizontal in a neutral position, as shown in FIG. 1. The retention spring 104 is bent upward into a vertical position when the mounting ring 100 is installed into a ceiling opening such that the retention spring 104 is passed through the ceiling opening. Once the retention spring 104 passes through the ceiling plane, the retention spring 104 springs back into the neutral horizontal position, biasing an inner surface of the ceiling. In certain example embodiments, the body ring 102 includes a plurality of slots 118 formed at various heights on the body ring 102. Thus, the retention spring 104 can be disposed within any one or the slots 118 depending on the preferred position of the retention spring 104 relative to the body ring 102. This allows the same mounting ring 100 to accommodate various ceiling thickness.

The flanges 106 are coupled to the bottom end 122 of the body ring 102 and extend outwardly from the body ring 102. In certain example embodiments, the flanges 106 are parallel to, and substantially flush with or adjacent to the bottom end 122 of the body ring 102. In certain example embodiments, the mounting ring 100 includes a plurality of flanges 106 coupled to the body ring 102 in different positions, such as at evenly spaced intervals. In certain other example embodiments, the flange 106 is a single continuous piece which encircles the entire circumference of the body ring 102. Alternatively, in certain example embodiments, the body ring 102 includes a rolled or flipped lip at the bottom end 122, which replaces the flange 106. Additionally, in certain other example embodiment, various clips, pins, and the like can be attached to the bottom end 122 of the body ring 102 to serve the functions of the flange 106, which are described below.

As described, when the mounting ring 100 is installed in a ceiling within a ceiling opening, the retention spring 104 is above the ceiling plane, biasing the inner surface of the ceiling. The biasing force of the retention spring 104 against the inner surface of the ceiling pulls the mounting ring 100 upward. As this occurs, the flange 106 is pulled against and grips the outer surface of the ceiling, given that the diameter of the ceiling opening is smaller than the diameter of the mounting ring 100 at the flange 106. Thus, a portion of the ceiling surrounding the opening is held in between the retention springs 104 and the flange 106, and the mounting ring 100 is secured within the opening. As described above, the retention springs 104 can be disposed in any of the slots 118, thereby varying the amount of space between the retention springs 104 and the flange 106. This allows the mounting ring 100 to be adapted for ceiling planes of different thicknesses. Alternatively, in certain example embodiments, the retention springs 104 can be mounted to the body ring 102 via brackets. The retention springs 104 and brackets can be attached to the body ring 102 at various heights to accommodate ceiling planes of varying thicknesses.

In certain example embodiments, the flange 106 and/or the body ring 102 further include screw openings 123 formed therein. When the mounting ring 100 is installed with an opening in the ceiling, the flange 106 and/or the body 102 can be further secured to the ceiling by screwing them into the ceiling via the screw openings 123. The screw openings 123 may be used if added security is desired, such as if the light fixture to be mounted is excessively heavy or if a more permanent solution is desired.

In certain example embodiments, the mounting ring 100 further includes a plurality of centering tabs 124. In one example embodiment, the centering tabs 124 are partially cut and hinge from the wall of the body ring 102. Thus, the centering tabs 124 can be pried out from being completely flush with the wall to being perpendicular to the wall, or any degree therebetween. This provides a varying distance from the tip of the centering tab to the wall. Thus, when the centering tabs 124 are pried out, the effective radius of the body ring 102 is increased by the distance from the tip of the center tabs 124 to the wall. Therefore, the mounting ring 100 can fit securely and be centered within a ceiling opening larger than the body ring 102. The degree to which the centering tabs 124 are pried out from the wall is determined according to how much larger the opening is than the body ring 102. In certain example embodiments, the centering tabs 124 each include an opening 126 through which a prying tool, such as a screwdriver can be inserted to pry out the tabs 124.

The centering tabs 124 are one embodiment of a centering mechanism used to stabilize and center the mounting ring 100 within a ceiling opening larger than the body ring 102. In certain example embodiments, other forms of centering mechanisms are used. In one alternate example embodiment, the mounting ring 100 includes a plurality of thumb screws threaded through the body ring 102 from the inside of the body ring 102. The thumb screws can be threaded through the body ring 102 to varying degrees, depending on the size of the ceiling opening, such that when the mounting ring 100 is disposed within the ceiling opening, the body ring 102 is centered and stabilized in the opening via the thumb screws. In certain other embodiments, the mounting ring 100 includes ball detents as the centering mechanism. In certain other example embodiments, additional spacers or supports are installed between the body ring 102 and the ceiling opening to center and stabilize the mounting ring 100.

The mounting ring 100 further includes a set of spring receivers 112. The spring receivers 112 are coupled to or are formed on the body ring 102. The spring receivers 112 extend or face inward from the wall of the body ring 102. In certain example embodiments, the spring receivers 112 are riveted to the body ring 102. In certain other example embodiments, the spring receivers 112 are formed with the body ring 102. In certain example embodiments, each of the spring receivers 112 includes two hooked ends. The spring receivers 112 are configured to engage with springs of a light fixture, thereby retaining the light fixture within the mounting ring 100. Specifically, a light fixture may have a V-shaped, Y-shaped, or other two-pronged spring which are spread in a neutral position. When installing the light fixture into the mounting ring 100, the prongs of the spring are pinched together and inserted through a spring receivers 112 between the two hooked ends. The prongs are then allowed to spread out into their neutral position, biasing the two hooked ends. As the prongs spread outward, the light fixture is pulled upward until a perimeter or lip of the light fixture grips or is pulled against the flange 106 of the mounting ring 100 or the ceiling if the mounting ring 100 in already installed in the ceiling. Thus, the light fixture is secured to the ceiling via the mounting ring 100. In certain example embodiments, the spring receivers 112 include a linear, rectangular, or elliptical slot through which the prongs of the spring traverse and then bias, rather than having two hooked ends.

Figure 2:
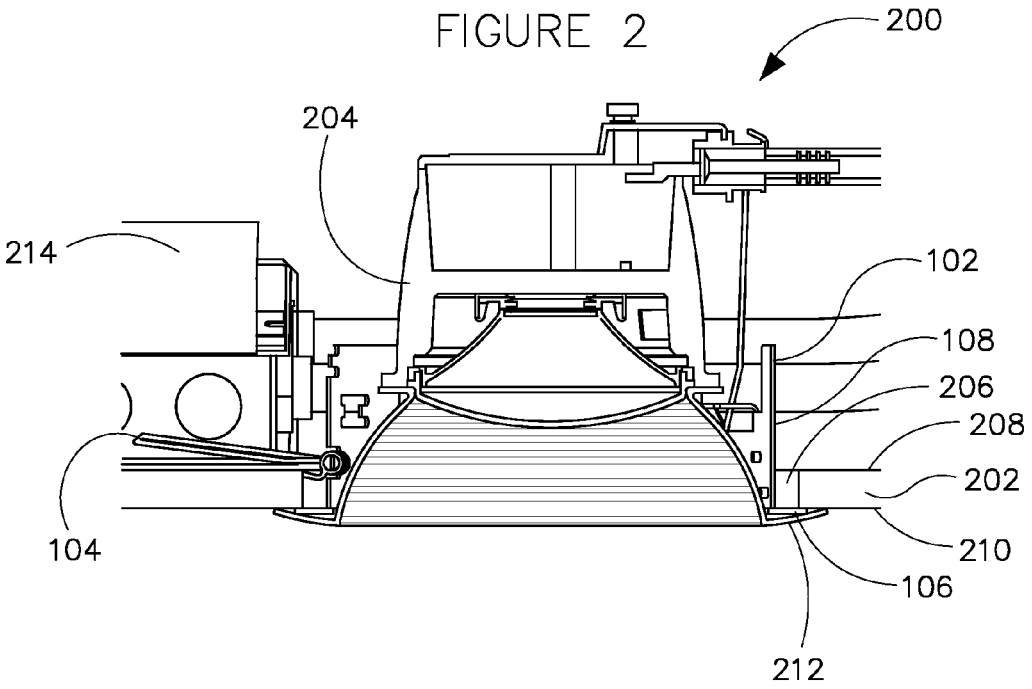
FIG. 2 illustrates a cross-sectional view of the mounting ring of FIG. 1 being used to mount a light fixture to a ceiling, in accordance with example embodiments of the present disclosure.

FIG. 2 illustrates a cross-sectional view of an assembly 200 in which the mounting ring 100 is mounted within a ceiling 202 and a light fixture 204 is coupled to the mounting ring 100, in accordance with example embodiments of the present disclosure. Specifically, the mounting ring 100 is mounted within an opening 206 in the ceiling 202, in which the retention spring 104 biases an inner surface 208 of the ceiling 202 and the flange 106 biases the outer surface 210 of the ceiling, effectively holding a portion of the ceiling 202 between the retention spring 104 and the flange 106, and securing the mounting ring 100 within the opening 206 and to the ceiling 202. The opening 206 is at least as large as the outside 108 of the body ring 102. In certain example embodiments, the opening 206 is larger than the outside 108 of the body ring 102. In such example embodiments, the flange 106 is larger than the difference in size between the body ring 102 and the opening, such that a portion of the ceiling 202 is still gripped between the flange 106 and the retention spring 104. Additionally in such embodiments, the centering tabs 124 (FIG. 1) are used to stabilize and center the body ring 102 within the oversized opening.

In certain example embodiments, the light fixture 204 is installed within the mounting ring 100 and is supported by the mounting ring 100. When fully installed, a lip 212 of the light fixture 204 is pulled against a portion of the outer surface 210 of the ceiling 202 surrounding the opening. In certain example embodiments, the lip 212 covers the flange 106 of the mounting ring 100. In certain example embodiments, the light fixture 204 is electrically coupled to a junction box 214 located above the ceiling 202.

Figure 3:
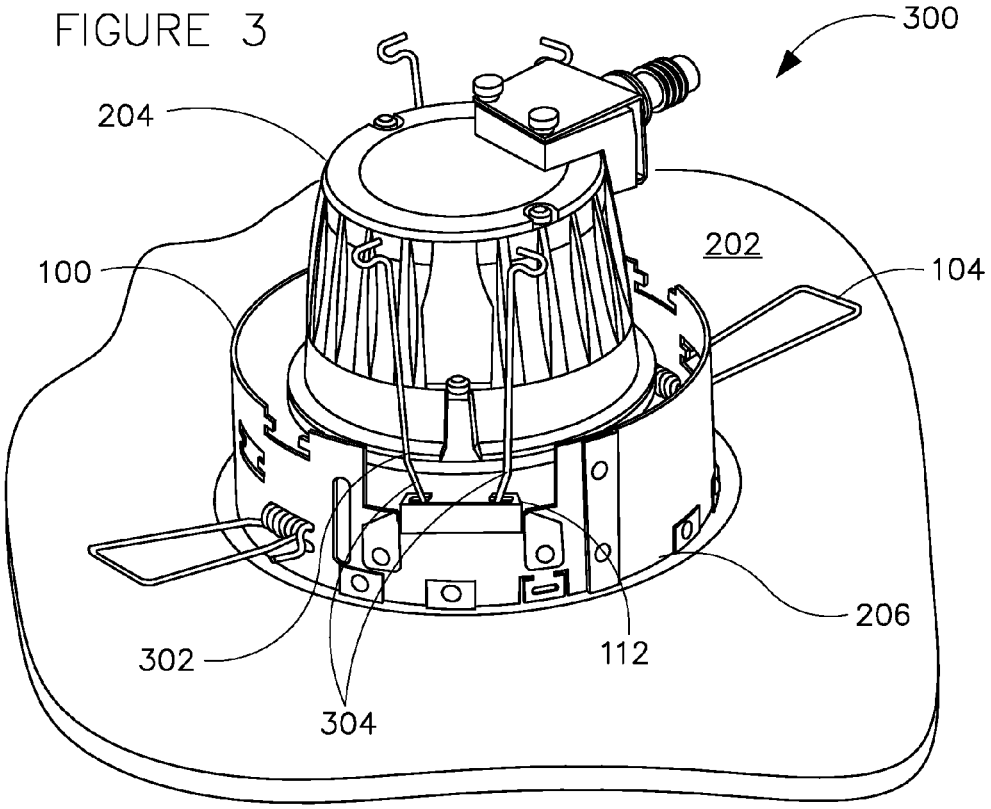
FIG. 3 illustrates a perspective view of the mounting ring with the light fixture of FIG. 2 from above the ceiling, in accordance with an example embodiment of the present disclosure.

FIG. 3 illustrates a perspective view of an assembly 300 in which the mounting ring 100 in mounted within an opening 206 in the ceiling 202, and the light fixture 204 is coupled to and supported by the mounting ring 100, in accordance with example embodiments of the present disclosure. Specifically, FIG. 3 illustrates an interaction between a spring 302 of the light fixture 204 and the spring receiver 112 of the mounting ring 100. The spring 302 is securely coupled to the light fixture 204 with a screw, rivet, or the like (not shown), such that the weight of the light fixture is supported by the spring 302. In certain example embodiments, the spring 302 includes two prongs 304. In such embodiments, to install the light fixture 204, the two prongs 304 are pinched together and inserted into the spring receiver 112. Then the prongs 304 are released and allowed to spread out into their neutral position, which is wider than the distance between the two hooks of the spring receiver 112. As the prongs 304 spread out against the spring receiver 112, the light fixture 204 is pulled upwards further into the ceiling 202 until the lip 212 of the light fixture 204 is pulled against the outer surface 210 of the ceiling or the flange 106 of the mounting ring 100. The light fixture 204 is thereby mounted to the mounting ring 100 and the ceiling 202. In certain example embodiments, the weight of the light fixture 204 is entirely supported by the engagement of the springs 302 and the spring receivers 112. In certain example embodiments, the spring receivers 112 of the mounting ring 100 have different designs or sizes, configured to be compatible with different types and sizes of light fixture springs 302. For example, a large or heavy light fixture may include larger springs 302 and require a more secure coupling effect with the spring receivers 112. Thus, the spring receivers 112 may be designed and sized to create such a coupling effect when engaged with the springs 302. In certain example embodiments, the spring receivers 112 are modular or interchangeable, and can be switched out with respect to the mounting ring 100 depending on the type of light fixture to be mounted. In certain example embodiments, the mounting ring 100 not only supports its own weight within the ceiling 202, but also the entire weight of the light fixture 204. Specifically, in certain example embodiments, the spring receivers 112 support the weight of the light fixture 204 and the retention springs 104 support the weight of the light fixture 204 and the mounting ring 100, although additional screw openings 123 (FIG. 1) are available if a more robust or permanent solution is desired.

The mounting ring 100 provides a coupling interface between new light fixtures and existing ceiling openings, allowing new light fixtures to be easily mounted to existing ceiling openings or existing fixture housings which alone are not capable of supporting the new light fixtures. The mounting ring 100 includes a ceiling mounting feature, such as the retention springs 104 and the flange 106 (FIG. 1), which secure the mounting ring 100 to the ceiling. The mounting ring 100 also includes a fixture coupling mechanism, such as the spring receivers 112 (FIG. 1), which couple to and support the light fixture. The fixture coupling mechanism is adapted according to the type of light fixture to be mounted. Other example embodiments of the mounting ring 100 include various other types of ceiling mounting features, various other types of the fixture coupling mechanisms, and various other body ring 102 styles, without departing from the spirit and scope of the mounting ring 100. Alternative example embodiments of such features are briefly described below while discussion of other example embodiments are omitted for the sake of brevity.

Figure 4:
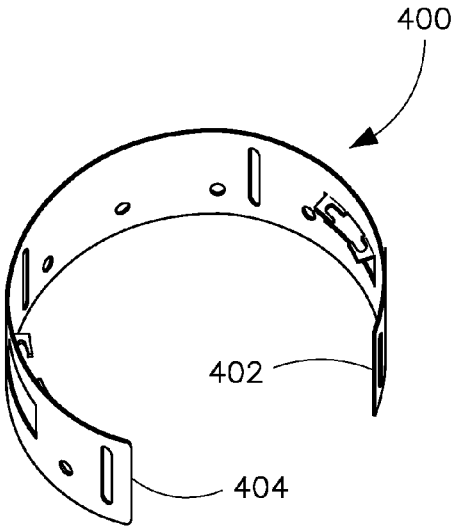
FIG. 4 illustrates a perspective view of an open-ended mounting ring, m accordance with example embodiments of the present disclosure.

FIG. 4 illustrates an open ended body ring 400 for a mounting nng, m accordance with example embodiments of the present disclosure. Referring to FIG. 4, the body ring 400 includes a first end 402 and a second end 404. The body ring 400 is flexible, giving it a variable diameter, depending on how close together the first and second ends 402, 404 are positioned. Thus, the same body ring 400 can be used in ceiling openings having various diameters. In order to use the body ring 400 in a ceiling opening that is smaller than the body ring 400 in its neutral position, the first and second ends 402, 404 are rolled towards each other until the body ring 400 will fit within the ceiling opening. In certain example embodiments, the first and second ends 402, 404 are released once in the ceiling opening, and the body ring 400 expands to fit within and lodge against the inner wall of the ceiling opening. In other embodiments, the first and second ends 402, 404 are secured into the position and remain secured in the ceiling opening.

Figure 5:
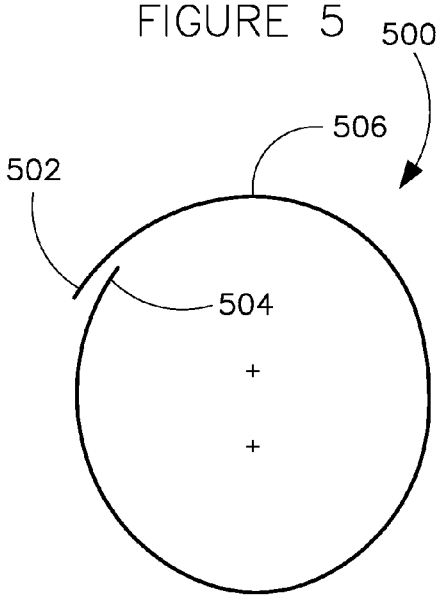
FIG. 5 illustrates a top view of coiled mounting ring, m accordance with example embodiments of the present disclosure.

FIG. 5 illustrates a top view of a coiled body ring 500 for a mounting ring, in accordance with example embodiments of the present disclosure. Referring to FIG. 5, the coiled body ring 500 includes a first coiled end 502 and a second coiled end 504. The first coiled end 502 and the second coiled end 504 overlap to form a substantially round shape. The amount of overlap between the first coiled end 502 and the second coiled end 504 determines the diameter of the body ring 500, such that the body ring 500 can be adjusted to various sizes. In certain example embodiments, the first coiled end 502 and the second coiled end 504 are not coupled to each other and the diameter of the body ring 500 is minimized by pushing the ends 502, 504 further past each other, or increasing the amount of overlap. Once installed within the ceiling opening, the ends 502, 504 can be let go and the diameter of the body ring 500 expands to fill the ceiling opening. In certain other example embodiments, the body ring 500 further includes a pivot 506, about which the body ring 500 can flex, allowing the body ring 500 to roll inside itself and adjust for different diameter ceiling openings. In an example embodiment, the coiled body ring 500 is fabricated from spring steel. In an example embodiment, the coiled body ring 500 includes barbs on its outer surface that grab into the wall of the ceiling opening when it expands to fill the ceiling opening. In certain example embodiments, the body rings 102, 400, 500 has a shape other than a conventional "ring" shape. In such example embodiments, the body ring 102 can be a square, rectangular, oval, triangle, or any other shape, including irregular shapes.

Figure 6:
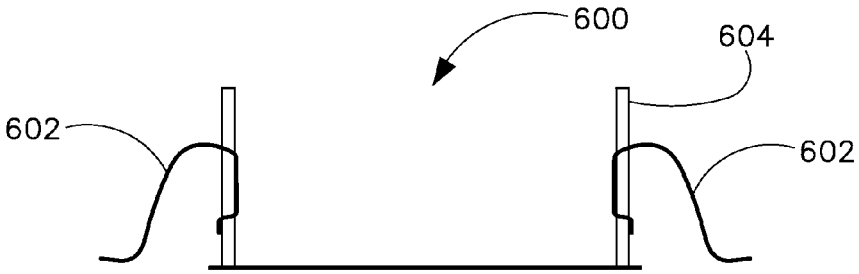
FIG. 6 illustrates a cross-sectional mounting ring with fold out clips, m accordance with example embodiments of the present disclosure.

FIG. 6 illustrates a cross-sectional partial view of a mounting ring 600 with fold out tabs 602. In its extended position, the fold out tabs 602 are disposed on the outside of the body ring 604. When the mounting ring 600 is mounting within a ceiling opening, the fold out tabs 602, which are on the outside of the body ring 604 as shown, rest on the inner surface of the ceiling and the mounting ring 600 is thereby supported within the ceiling. When installing the mounting ring 600 into the ceiling opening, the fold out tabs 602 are kept in a retracted position inside the mounting ring 600 so that the mount ring 600 can be inserted within the ceiling opening.

Figure 7A:
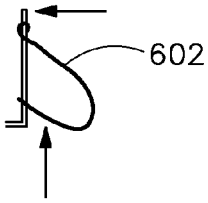
FIGS. 7*a*-7*c* illustrates steps of engaging the fold out clips of FIG. 6, m accordance with example embodiments of the present disclosure.
Figure 7B:
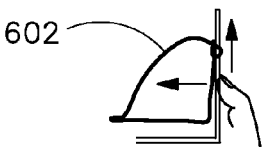
Figure 7C:
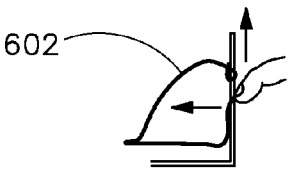

FIGS. 7*a*-7*c* illustrate steps of manipulating the fold out tabs 602 when installing or removing the mounting ring 600 to a ceiling, in accordance with example embodiments of the present disclosure. Specifically, FIG. 7*a* illustrates the fold out tab 602 in the retracted position where the fold out tab 602 is within the mounting ring 600. The mounting ring 100 is inserted into the ceiling opening with the fold out tabs 602 in this position. FIG. 7*b* illustrates the fold out tab 602 in a fully extended position, in which the fold out tab 602 is outside of the mounting ring 600 and resting on the inner surface of the ceiling. After the mounting ring 600 is fully disposed within the ceiling opening, and the fold out tab 602 is above the ceiling plane, the fold out tab 602 is pushed out from inside the mounting ring 600 to the outside of the mounting ring 600 via a slot in the body ring. Thus, a portion of the ceiling surrounding the ceiling opening supports the fold out tab 602 and the mounting ring 600 is supported within the ceiling. In certain example embodiments, the fold out tab 602 is put into the extended position by pushing or sliding the foldout tab 602 up and out, as shown in FIG. 7*b*. FIG. 7*c* illustrates retracting the fold out tab 602 from the extended position back into the retracted position, such as for removing the mounting ring 600 from the ceiling or for preparing the mounting ring 600 to be installed into the ceiling. In certain example embodiments, the fold out tab 602 is retracted into the mounting ring 600 by pulling the fold out tab 602 in and down through the slot and back into the mounting ring 600, as shown in FIG. 7*c*. The fold out tabs 602 serve substantially the same purpose as the retention springs 104 (FIG. 1) and therefore can replace the retention springs 104 in certain example embodiments.

Figures 8A, 8B, 9:
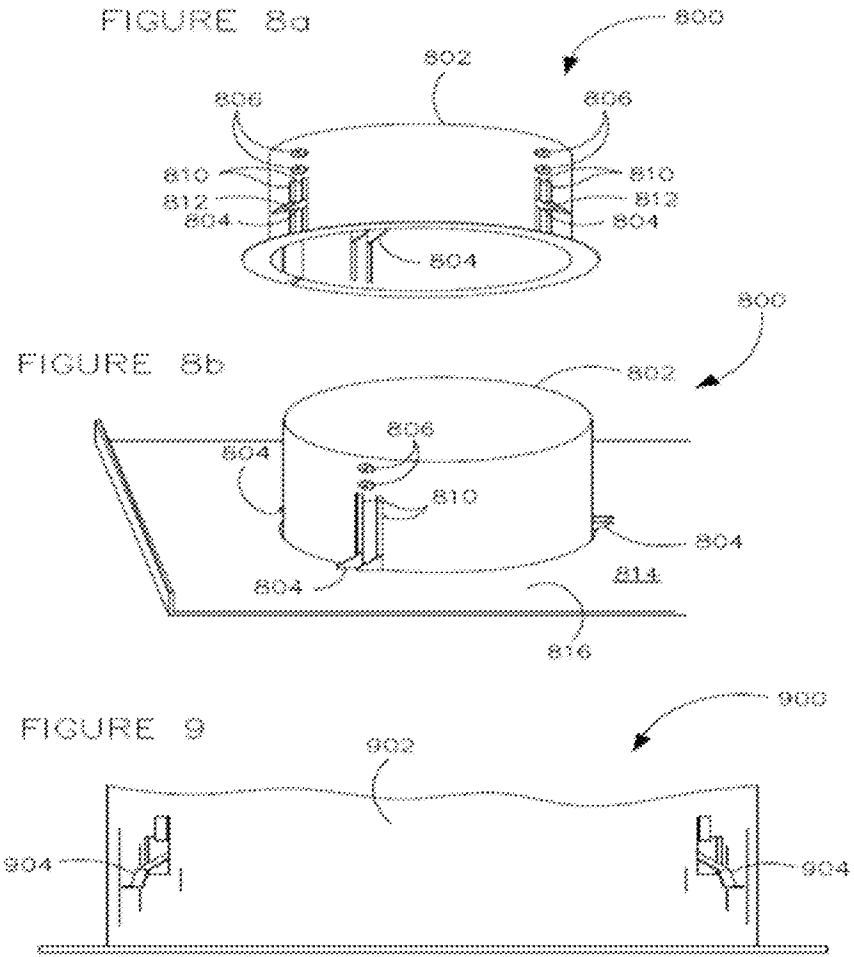
FIG. 8*a* illustrates a perspective view of a mounting ring with flex clamps, in accordance with example embodiments of the present disclosure.
FIG. 8*b* illustrates a perspective view of the mounting ring of FIG. 8*a* installed in a ceiling, in accordance with example embodiments of the present disclosure.
FIG. 9 illustrates a perspective view of a mounting ring with spring clips, in accordance with example embodiments of the present disclosure.

FIG. 8*a* illustrates a perspective view of a mounting ring 800, in accordance with example embodiments of the present disclosure. The mounting ring 800 includes spring clamps 804 which are fastened to the body ring 802 at one end via one or more screws 806 on an inner surface of the body ring 802. The spring clamps 804 in their neutral position, extend from the inside of the mounting ring 800 to the outside of the mounting ring 800 via one or more slots 810 formed in the body ring 802. With enough force, the spring clamps 804 can be pushed in towards the body ring 802 such that the spring clamps 804 are flush with the body ring 802. In certain example embodiments, the spring clamps 804 have a tapered top side 812 which translates downward force into a component of perpendicular inward force. When the mounting ring 800 is installed into a ceiling opening, the perimeter of the ceiling opening initially hits the outwardly extended spring clamps 804. Then as the mounting ring 800 is pushed upward, the perimeter of the ceiling opening applies a force on the tapered top side 812 of the spring clamps 804 and pushes the springs clamps 804 into the body ring 802. Thus, the mounting ring 800 can be fully disposed within the ceiling opening and the spring clamps are disposed above the ceiling.

FIG. 8*b* illustrates the mounting ring 800 when it is fully disposed within the ceiling 814, in accordance with example embodiments of the present disclosure. When the mounting ring 800 is fully disposed within the ceiling 814, the spring clamps 804 are above the ceiling 814. Thus, without the force of the ceiling on the spring clamps 804, the spring clamps 804 spring back out into their neutral position of extending out past the body ring 802. Thus, the spring clamps 804 extend out and bias the inner surface 816 of the ceiling 814, securing the mounting ring 800 within the ceiling 814. Similar to the fold out tabs 602 (FIG. 6), the spring clamps substantially serve the same purpose as the retention springs 104 (FIG. 1) and therefore can replace the retention springs 104 in certain example embodiments.

FIG. 9 illustrates a front view of a mounting ring 900, in accordance with example embodiments of the present disclosure. The mounting ring 900 includes spring clips 904 which extend out from the body ring 902. The spring clips 904 extend outward in a neutral position and become substantially flush against the body ring 902 when depressed. Thus, when installing the mounting ring 900 into a ceiling opening, the spring clips 904 are depressed by the inner wall of the ceiling opening. Once the spring clips 904 pass the ceiling plane, the spring clips 904 spring back out into their neutral position and bias the inner surface of the ceiling, thereby securing the mounting ring 900 within the ceiling.

In certain example embodiments, the ceiling mounting feature is formed in the body ring. For instance, in an example embodiment, the body ring includes a plurality of tabs formed within the wall of the body ring, similar to the pry out tab 112 (FIG. 1). During installation, the tabs are flush with the body ring. After the mounting ring is disposed within the ceiling opening and the tabs are above the ceiling, the tabs are bent outward at an angle such that the tabs bias the inner surface of the ceiling, thereby supporting the mounting ring. Various other features or elements can be used to secure the mounting ring within the ceiling other than those described herein. Such embodiments include the use of various posts, pins, clips, clamps, springs, hooks, latches, and the like.

Accordingly, although embodiments of the present disclosure have been described herein in detail, the descriptions are by way of example. The features of the disclosure described herein are representative and, in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

What is claimed is:

1. A mounting ring, comprising:

a cylindrical body ring comprising a top end, a bottom end, an outer side, and an inner side;

at least one spring receiver disposed on the body ring;

at least one retention spring disposed on the body ring and comprising an outwardly extending arm;

a lip disposed on the bottom end and extending outwardly from the body ring, wherein the at least one retention spring and the lip grip a portion of a ceiling therebetween when the mounting ring is disposed within the ceiling; and a plurality of outwardly extendable tabs disposed on the body ring, wherein the plurality of extendable tabs are flush with the body ring in a first position and perpendicularly extend from the body ring in a second position, wherein the extendable tabs are positionable anywhere between the first position and the second position.

2. The mounting ring of claim 1, wherein the at least one spring receiver retains at least one spring prong of a fixture when the fixture is disposed within the mounting ring, wherein the mounting ring supports the fixture via engagement of the at least one spring receiver and the at least on spring prong.

3. The mounting ring of claim 1, wherein the body ring further comprises a plurality of retention spring coupling elements configured to couple the at least one retention spring to the body ring, and wherein the plurality of retention spring coupling elements are disposed about the body ring at varying heights with respect to the bottom end of the body ring.

4. The mounting ring of claim 1, wherein each of the plurality of outwardly extendable tabs comprise an aperture for prying the tabs outward.

5. The mounting ring of claim 1, wherein the plurality of outwardly extendable tabs secure and center the mounting ring within the ceiling.

6. The mounting ring of claim 2, wherein the at least one spring receiver is modular and interchangeably coupled to the body ring, and wherein a first sized spring receiver is interchangeable with a second sized spring receiver with respect to the body ring.

7. A mounting device, comprising:

a body frame comprising a first open end, a second open end, an inside, and an outside, wherein the body frame is attachable to an opening in a ceiling;

at least one coupling receiver disposed on the inside of the body frame, wherein the coupling receiver is configured to engage with and retain at least one coupling feature of a fixture when the fixture is inserted within the mounting device; and a plurality of outwardly extendable tabs disposed on the body frame, wherein the plurality of extendable tabs are flush with the body frame in a first position and perpendicularly extend from the body frame in a second position, wherein the extendable tabs are positionable anywhere between the first position and the second position.

8. The mounting device of claim 7, wherein the body frame comprises a rectangular shape.

9. The mounting device of claim 7, wherein the mounting device supports the weight of the fixture when the at least one coupling receiver of the mounting device is engaged with the at least one coupling feature of the fixture.

10. The mounting device of claim 7, wherein the plurality of outwardly extendable tabs secure and center the mounting ring within the ceiling.

11. The mounting device of claim 7, wherein the at least one coupling receiver is modular and interchangeably coupled to the body frame, and wherein a first sized spring receiver is interchangeable with a second sized spring receiver with respect to the body frame.

12. A mounting device, comprising:

a frame comprising a top open end, a bottom open end, an outer side, and an inner at least one fixture receiver disposed on the frame configured to engage with at least one coupling element of a fixture when the fixture is disposed within the frame, wherein the mounting device supports the fixture via the engagement of the at least one fixture receiver with the at least one coupling element of the fixture;

at least one ceiling attachment feature coupled to the frame configured to secure the mounting device within an opening in a ceiling; and a lip extending out from the bottom open end of the frame, wherein the at least one ceiling attachment feature and the lip grip a portion of the ceiling therebetween when the mounting device is disposed within the opening.

13. The mounting device of claim 12, wherein the ceiling attachment feature comprises a plurality of fold out tabs.

14. The mounting device of claim 13, wherein the plurality of fold out tabs have a first position wherein the fold out tabs are disposed within the frame when the mounting device is inserted into the opening in the ceiling.

15. The mounting device of claim 13, wherein the plurality of fold out tabs have a second position wherein the plurality of fold out tabs are inserted through a respective plurality of slots in the frame such that the plurality of fold out tabs extend out from the frame and secure the mounting device to the ceiling.

16. The mounting device of claim 12, wherein the ceiling attachment feature comprises a plurality of spring clamps attached to the frame.

17. The mounting device of claim 16, wherein the plurality of spring clamps extend through slots in the frame and extend from the outer side of the frame.

18. The mounting device of claim 16, wherein each of the plurality of spring clamps comprise a tapered top side to facilitate inserting the mounting device into the opening in the ceiling.

19. The mounting device of claim 12, further comprising:

a plurality of centering elements disposed about the frame and outwardly extending from the frame, wherein the plurality of centering elements have adjustable degrees of extension from the frame, and wherein the plurality of centering elements stabilize or center the frame within the opening in the ceiling when the opening is larger than the frame.

* * * * *